US005671897A

United States Patent [19]

Ogg et al.

[11] Patent Number: 5,671,897

[45] Date of Patent: Sep. 30, 1997

[54] CORE FOR CORE WOUND PAPER PRODUCTS HAVING PREFERRED SEAM CONSTRUCTION

[75] Inventors: Randy Gene Ogg, Cincinnati, Ohio; Martin Henry Stark, Saginaw, Mich.

[73] Assignee: The Procter & Gamble Company, Cincinnati, Ohio

[21] Appl. No.: 743,396

[22] Filed: Nov. 4, 1996

Related U.S. Application Data

[63] Continuation of Ser. No. 638,403, Apr. 29, 1996, abandoned, which is a continuation of Ser. No. 441,498, May 15, 1995, abandoned, which is a division of Ser. No. 268,414, Jun. 29, 1994, abandoned.

[51] Int. Cl.[6] ..... B65H 75/18

[52] U.S. Cl. ..... 242/610.1; 138/144; 156/188; 156/195; 428/37

[58] Field of Search ..... 242/118.8, 118.32, 242/610.1; 138/129, 130, 144, 154, 137, 145, DIG. 7; 156/188, 190, 195, 244.13, 273.1; 428/34.2, 37

[56] References Cited

U.S. PATENT DOCUMENTS

| | | | |
|---|---|---|---|
| 1,920,081 | 7/1933 | John | 138/144 X |
| 2,035,304 | 3/1936 | Dieffenbach | 138/144 |
| 2,623,445 | 12/1952 | Robinson | 93/94 |
| 2,751,936 | 6/1956 | Dunlap et al. | 138/78 |
| 2,755,821 | 7/1956 | Stahl | 138/76 |
| 2,888,043 | 5/1959 | Reid | 138/78 |
| 3,234,970 | 2/1966 | Baker et al. | 138/129 X |
| 3,274,905 | 9/1966 | Dempsey, Jr. et al. | 156/190 X |
| 3,338,270 | 8/1967 | Denenberg | 138/144 |
| 3,421,550 | 1/1969 | Whaley et al. | 138/144 |
| 3,429,522 | 2/1969 | Cunningham et al. | 242/118.32 |
| 3,524,779 | 8/1970 | Masters et al. | 156/190 |
| 3,616,819 | 11/1971 | Dunlap, Jr. et al. | 138/144 |
| 3,620,869 | 11/1971 | Stump et al. | 156/190 |
| 4,026,690 | 5/1977 | McClellan | 242/118.32 X |
| 5,167,994 | 12/1992 | Paulson | 428/34.2 |

*Primary Examiner*—Daniel P. Stodola
*Assistant Examiner*—William A. Rivera
*Attorney, Agent, or Firm*—Larry L. Huston; E. Kelly Linman; Jacobus C. Rasser

[57] ABSTRACT

A core for core wound paper products. The core is made by wrapping dual plies in a spiral pattern and adhering the plies together. The edge of one ply overlaps the ply gap of the other ply, preventing a single ply thickness from occurring anywhere on the core. Alternatively, the edge of each ply may overlap the ply gap of that respective ply. In yet another embodiment, the overlap may be formed by a separate ply applied to either ply.

3 Claims, 4 Drawing Sheets

CORE FOR CORE WOUND PAPER PRODUCTS HAVING PREFERRED SEAM CONSTRUCTION

This is a continuation of application Ser. No. 08/638,403, filed on Apr. 29, 1996, now abandoned; which is a continuation application of Ser. No. 08/441,498, filed May 15, 1995, now abandoned; which is a divisional application of Ser. No. 08/268,414, filed Jun. 29, 1994, now abandoned.

FIELD OF THE INVENTION

This invention relates to cores for core wound paper products, such as toilet tissue and paper towels, and more particularly to cores having improved physical properties and which reduce total raw material usage.

BACKGROUND OF THE INVENTION

Core wound paper products are in constant use in daily life. Particularly, toilet tissue and paper towels have become a staple in home and industry. Such products usually comprise a roll of a paper product spirally wrapped around a hollow core.

The hollow cores are typically made on a coremaking line and comprise inner and outer plies of paperboard superimposed in face-to-face relationship. Each ply of the paperboard is supplied to a coremaking mandril from a spool of raw material. When the two plies are fed to the coremaking mandril, they are typically helically wrapped in the same direction. During wrapping, the plies are adhered throughout to maintain the desired cylindrical configuration.

During converting, the cores are telescoped onto a mandril for subsequent processing—such as winding the paper product therearound. The mandrils are rapidly accelerated, which often causes the cores to burst. Core bursting is the phenomenon which describes a core rupturing on a mandril and disintegrating into strips of paperboard.

Core bursting cause two problems. First, there is a significant loss in efficiency as the mandril must be cleaned and restarted again and again until it runs smoothly and without core bursting occurrences. Secondly, each occurrence of core bursting causes material to be scrapped and increases manufacturing costs due to the excess of raw materials necessary to support each startup.

Of course, any time one desires to reduce material costs of the core, the first solution which comes to mind is to reducing the amount of materials used in the construction of the core. However, this "solution" has the drawback of further weakening the core, making it more susceptible to core bursting on the converting mandril—and the cycle repeats itself.

If the core survives the converting mandril, there are other occasions where the properties of the core may cause it to be damaged before the core (and the paper product wound therearound) reach the consumer. For example, if the side to side (diametrical) crush strength of the core is not great enough, the core may collapse and cause the converting line to jam. In the converting line, cores are horizontally stacked several feet high in a converting bin. The converting bin has a trap door at the bottom which opens to feed the cores onto the line. The cores at the bottom of the converting bin must resist being crushed by the cores above while stacked in the bin and while fed into the line. If a core does not have sufficient side to side crush resistance, it will crush either blocking the cores from dumping into the converting line or will jam while in the line. In either occurrence, the converting line will incur a shutdown to clear the jam. Of course, the crushed cores must be discarded after they are cleared from the converting bin.

Assuming the core survives the converting mandril (and the balance of the line) without exploding, the core is shipped with product wound therearound to a warehouse, where cores are typically axially stacked in their cases. The cases of product wrapped cores are stacked several feet high in a warehouse and often are subjected to an axial compressive force in excess of 300 pounds. The cores at the bottom of the stacks must have sufficient crush strength to resist this axial compressive force, otherwise they will be crushed and the product may be too damaged to sell. Furthermore, if the cores at the bottom of the pallets are crushed, often gross deformation of these products occurs and the cases stacked near the top of the pallet fall over and are also damaged.

Accordingly, it is an object of this invention to reduce the material costs associated with making cores for core wound paper products. Furthermore, it is an object of this invention to increase the efficiency and speed at which the cores can be manufactured. Finally, it is an object of this invention to provide such cores having improved physical properties.

SUMMARY OF THE INVENTION

The invention is a multi-ply core for core wound paper products. In a preferred embodiment, the core comprises two plies, an inner ply and an outer ply. The two plies are joined together in face-to-face relationship and being helically wound together to form a hollow cylinder having helical ply gaps. The helical ply gaps are defined by the edges of the plies. The core has a thickness of at least two plies throughout its entire surface area.

The multi-ply core may have either the inner or outer ply overlap itself at a location registered with the ply gap formed by the other ply. Alternatively, a third ply having a width less than the width of the inner and outer plies may be provided and registered in an overlapping configuration with the ply gap of the inner ply or the outer ply.

BRIEF DESCRIPTION OF THE DRAWINGS

While the Specification concludes with claims particularly pointing out and distinctly claiming the present invention, it is believed the same will be better understood from the following description taken in conjunction with the accompanying drawings in which like parts are given the same reference numeral. The ply gaps and extensions are shown exaggerated for clarity.

FIGS. 2A–6 illustrate cores in a flat unfolded configuration, having the inner and outer plies shown separated for clarity.

FIG. 2A is a fragmentary end view of the core of FIG. 1A.

FIG. 3 is a fragmentary end view of a core according to the present invention having the outer ply overlap itself at the ply gap of the inner ply.

FIG. 4 is a fragmentary end view of a core according to the present invention having the inner ply overlap itself at the ply gap of the outer ply.

FIG. 5 is a fragmentary end view of an alternative embodiment of a core according to the present invention having a reinforcing third ply applied to the ply gap of the outer ply.

FIG. 6 is a fragmentary end view of an alternative embodiment of a core according to the present invention having ply gaps offset 180° and overlaps at both the inner and outer ply gaps.

DETAILED DESCRIPTION OF THE INVENTION

Figure 1:
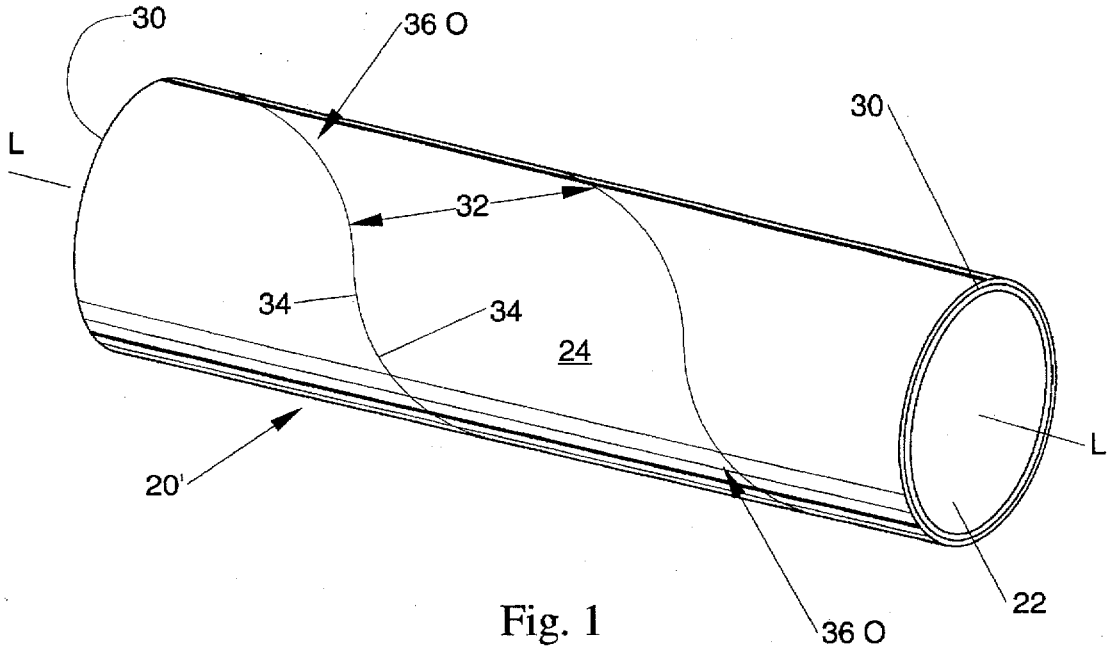
Fig. 1 prior art
FIG. 1 is a perspective view of a core according to the prior art.
Figure 1A:
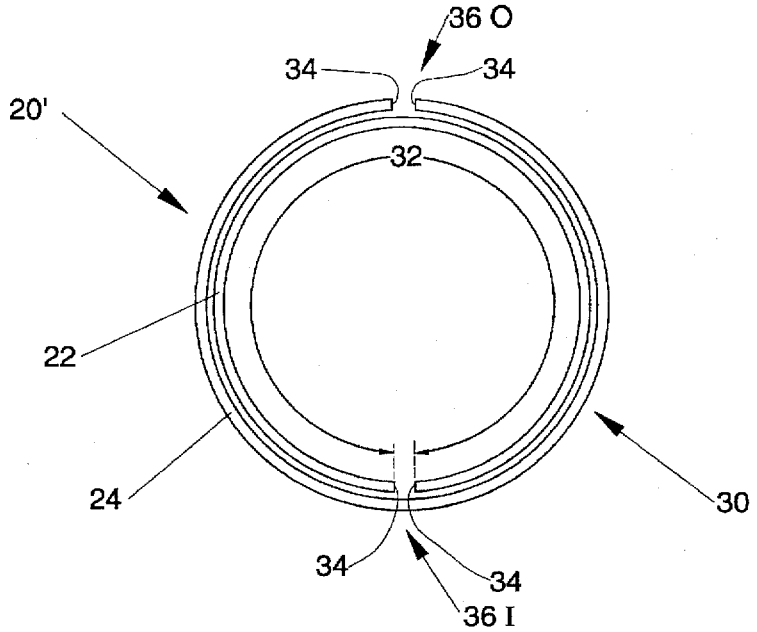
Fig. 1A prior art
FIG. 1A is an end view of the core of FIG. 1.

Referring to FIGS. 1 and 1A, a core 20' according to the prior art comprises an inner ply 22 and an outer ply 24 joined in face-to-face relationship to form a hollow cylinder having two opposed ends 30 defining a finite length. The plies 22, 24 are helically wound. As used herein helical windings include volute and spiral arrangements.

Each ply 22, 24 has a particular width 32 defined by two edges 34. The edges 34 of the inner ply 22 and outer ply 24 butt up to one another to form a ply gap 36I, 36O therebetween. The inner ply 22 is oriented towards a central longitudinal axis L—L of the core 20'. The outer ply 24 is oriented away from the longitudinal axis L—L of the core 20' and contacts the paper product when it is wound around the core 20'. As used herein "longitudinal" refers to the direction parallel the longitudinal axis L—L. The core 20' is typically elongate, having an axial dimension which is large relative to the diameter.

When toilet tissue is wound on the core 20', the resulting core wound paper product of toilet tissue typically has a diameter of about 4.00 to 5.00 inches and a length of about 4.50 inches between the ends 30. If a core 20' embodying the present invention is used for paper towels, the core wound paper product of paper towels typically has a diameter of about 4.00 to 6.25 inches and a length of about 11.0 inches for the embodiments described herein.

The core 20' may be made of two plies 22, 24 of a paperboard having any suitable combination of cellulosic fibers such as bleached krafts, sulfites, hardwoods, softwoods, and recycled fibers. The core 20' should exhibit uniform strength without weak spots. The core 20' may have a wall thickness of at least about 0.016 inches, as and preferably has a thickness of at least about 0.028 inches. The core 20' should be free of objectionable odors, impurities or contaminants which may cause irritation to the skin.

The core 20' may be made of paperboard having a basis weight of about 19 to 42 pounds per 1,000 square feet, although cores 20' having a basis weight as high as 47 pounds per 1,000 square feet have been found to work well in the present invention. For the embodiments described herein, the material used for the core 20' should have a cross machine direction ring crush strength of at least about 50 pounds per inch, and preferably at least about 60 pounds per inch as measured according to TAPPI Standard T818 OM--87.

The two plies 22, 24 may be wrapped at an angle of about 31 to about 37 degrees, preferably about 34 degrees from the longitudinal direction. The inner and outer ply gaps 36I, 36O are typically offset from each other 180 degrees, as it is believed this configuration maximizes strength due to distributing the weak regions of the core 20' as far apart as possible. To maintain the face-to-face relationship of the inner and outer plies 22, 24, they may be adhered together with starch based dextrin adhesive, such as product number 13-1622 available from the National Starch & Chemical Company of Bridgewater, N.J. Generally a full coverage of adhesive at the interface between the inner and outer plies 22, 24 is preferred to minimize occurrences of core 20' failures due to the lack of full lamination of the plies 22, 24. It is important that the plies 22, 24 be adhesively joined at the overlap 42 to provide strength. The adhesive is conventionally applied to the inner face of the outer ply 24 because the outside of each ply 22, 24 must run over a tracking bar.

Figure 2A:
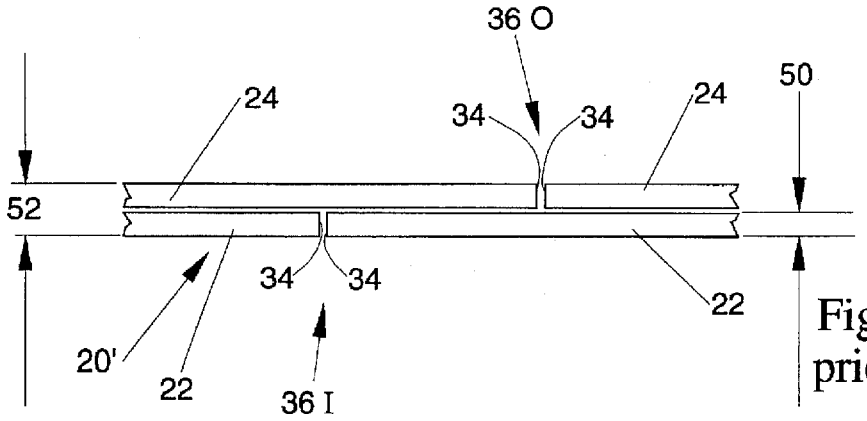
Fig. 2A prior art

Referring to FIG. 2A, in one embodiment according to the prior art, the edges 34 of the inner and outer plies 22, 24 are offset from each other 180 degrees and are butted up against the opposing edge 34. This arrangement provides the disadvantage that at two locations throughout the core 20' only a single ply thickness 50 is present—even if the opposed edges 34 are in contact with each other. The two locations, of course, are the ply gaps 36I, 36O of the core 20'. It must be recognized the ply gaps 36I, 36O of the cores 20' are not individual points as indicated by the sectional views shown in the figures, but rather are two continuous lines which extend the entire longitudinal length of the core 20' between its opposed ends 30. This arrangement, while ostensibly minimizing material usage, suffers from various drawbacks. First, the resistance to core 20' rupture is minimized. More of such cores 20' will be scrapped during converting due to the greater chances of exploding or being crushed. Hence scrap increases and converting line efficiency decreases. Also, such a core 20' has relatively low values of side to side crush resistance and axial crush resistance.

Figure 2B:
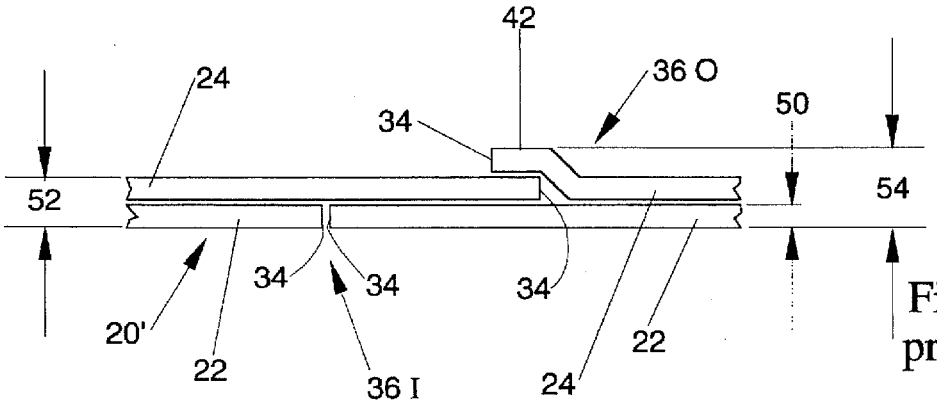
Fig. 2B prior art
FIG. 2B is a fragmentary end view of an alternative embodiment of a core according to the prior art wherein the outer ply overlaps itself but not the ply gap of the inner ply.

One attempt in the prior art to improve this arrangement, illustrated in FIG. 2B, overlaps the edge 34 of the outside ply 24 upon itself for a short distance, typically ⅛ to ⅜ of an inch. However, the edge 34 at the overlap 42 of the outer ply 24 is offset from the ply gap 36O of the inner ply 22. Accordingly, this arrangement also has only a single ply thickness 50 at the ply gaps 36I, 36O. While such a core 20' may have slightly improved side to side and axial crush resistances, it also still suffers from the high scrap rates and converting line bursting inefficiencies discussed above.

Figure 3:
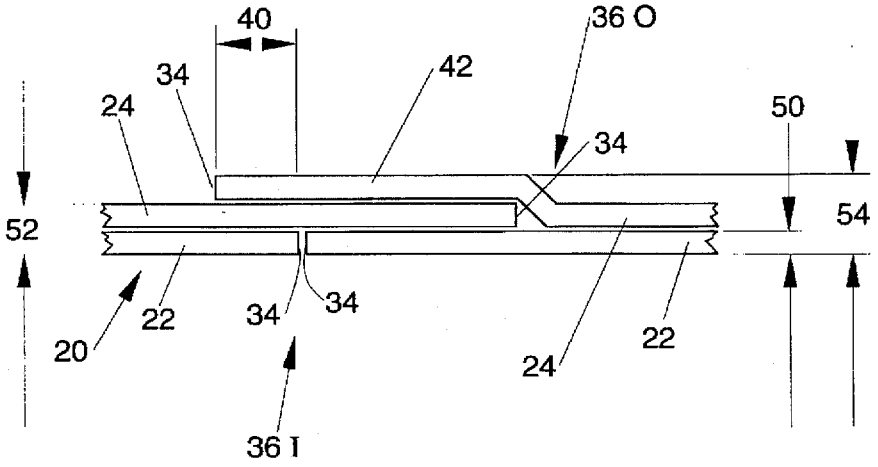

As illustrated in FIG. 3, improvement may be recognized if the outer ply 24 not only overlaps itself, but also overlaps and extends beyond the ply gap 36I of the inner ply 22. This arrangement requires registration of the overlap 42 of one ply 22 or 24 with the ply gap 36O or 36I of the other ply 24 or 22 and has the advantage that the core 20' has a two-ply thickness 52 (which is adhesively bonded) throughout its entire surface area. Furthermore, there are two helical third plies of three-ply thickness 54, where the overlaps 42 occur. The overlap 42 of the outer ply 24 on itself should provide an extension 40 between the ply gap 36O of the outer plies 24 of at least 3/16 inches, and preferably at least ⅜ inches. The extension 40 is the circumferential distance from the edge 34 of one ply 22, 24 to the ply gap 36O, 36I of the other ply as measured along the overlap 42.

Furthermore, the edge 34 of the ply gap 36I of the inner ply 22 and the ply gap 36O of the outer ply 24 should be offset. This arrangement provides an extension 40 between the edge 34 of one ply 22, 24 and the ply gap 36O, 36I of the other ply 24, 22. A suitable configuration has an extension 40 between the inner ply 22 and outer ply 24 of approximately one-half of the amount of the overlap 42. An extension 40 in the amount of about 3/16 inches has been found particularly suitable for the embodiments described herein.

This arrangement may be accomplished by using an outer ply 24 having a greater width 32 between the edges 34 than does the inner ply 22. One arrangement which has been found suitable is an inner ply 22 with a width 32 of about 2.875 inches and an outer ply 24 with a width 32 of about 3.25 inches.

Figure 4:
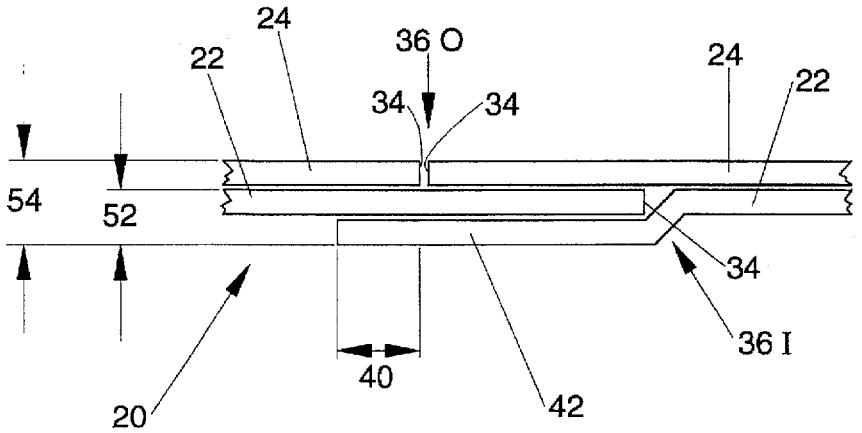

Referring to FIG. 4, in an alternative embodiment, the inner ply 22 overlaps itself in a manner similar to that described above with respect to the outer ply 24. This arrangement, while being more difficult to execute on the coremaking mandril, provides the advantage that the outwardly facing surface of the outer ply 24 is smoother and will not disrupt the winding process when the paper product is wound therearound and more readily accepts the adhesive to retain the paper product when winding begins. However, a disadvantage of this arrangement is that the overlap 42 of the inner ply 22 is more likely to catch at the exposed edge 34 when the core 20 is loaded onto the converting mandril.

Figure 5:
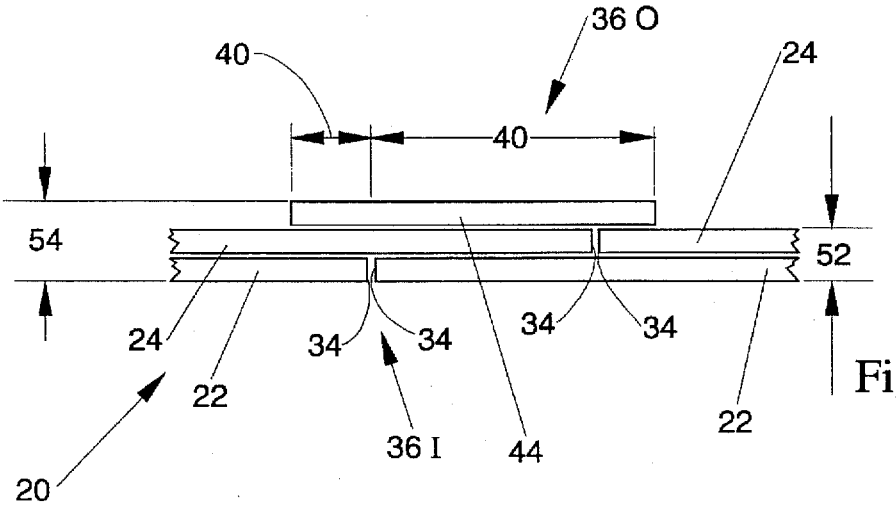

Referring to FIG. 5, in a third embodiment, a separate ply 44 may be applied to overlie the outer ply gap 36O (as shown) or, hypothetically, a separate ply 44 may be applied to overlie the inner ply gap 36I (not shown). This arrangement provides a two-ply thickness 52 at the ply gap 36O or 36I to which the separate ply 44 was applied, and a three-ply thickness 54 outboard of the ply gap 36O or 36I.

Hypothetically, this arrangement would entail more difficulty in execution as three spools of the raw material are necessary, but has the advantage of two spools of the same width 32 to be used for the inner ply 22 and outer ply 24.

Figure 6:
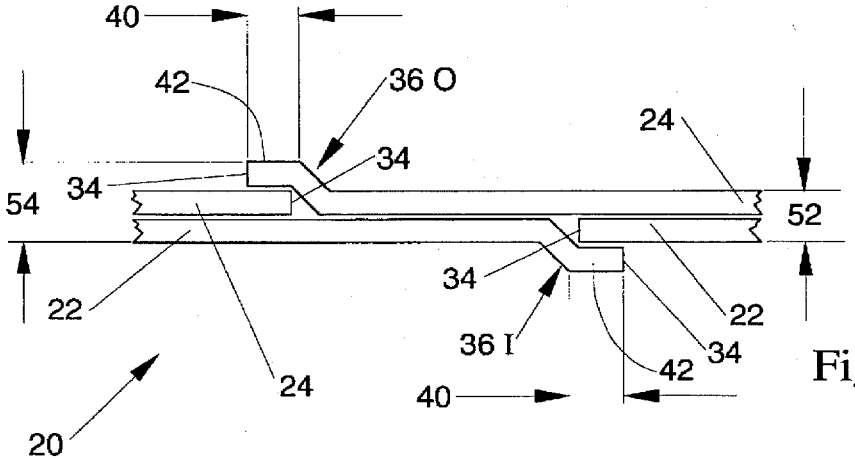

Referring to FIG. 6, in yet another embodiment, the edge 34 of the outer ply 24 may overlap its ply gap 36O a short distance. However, in this embodiment, the ply gap 36I of the inner ply 22 has an extension 40 from the ply gap 36O of the outer ply 24 sufficient that the overlap 42 of the outer ply 24 is not registered with the ply gap 36I of the inner ply 22. However, to compensate for this extension 40, in this embodiment, the edge 34 of the inner ply 22 overlaps the ply gap 36I of the inner ply 22. In this arrangement, two overlaps 42 are provided, one for each of the ply gaps 36I, 36O.

Cores 20 made according to the prior art (FIG. 2A) and according to the present invention (FIG. 3) and having various amounts of overlap 42 were made on The Procter & Gamble Company converting line at Mehoopany, Pa. Contrary to expectations founded in the prior art, it was found that less raw material was used per case of cores 20 produced when more material was used per core 20, when an overlap 42 of about ⅜ inch was utilized.

Figure 7:
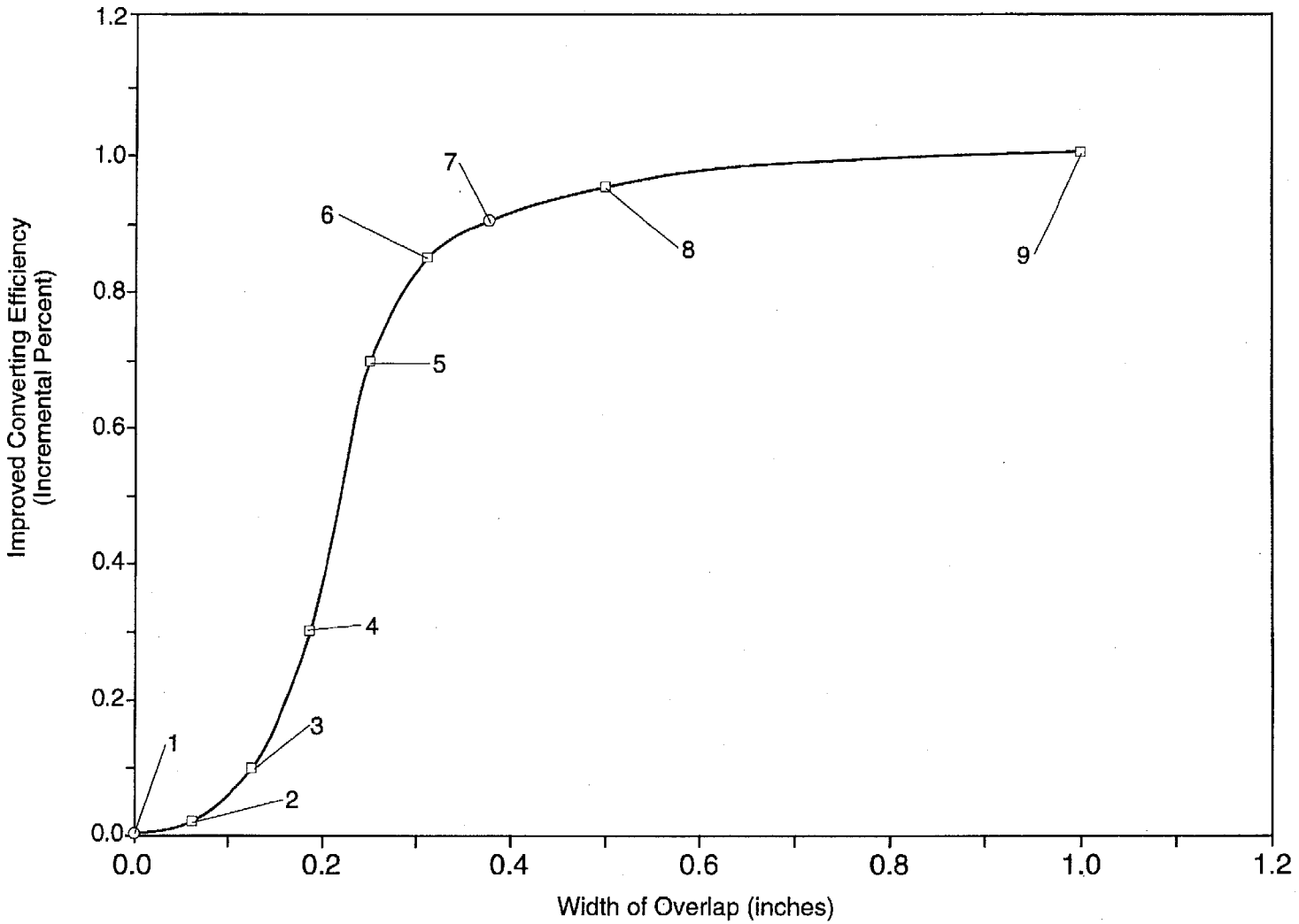
FIG. 7 is a graphical representation of the effects of this invention on converting efficiency.

This outcome is illustrated in FIG. 7, wherein the side to side axis designates the amount of overlap 42, and the axial axis designates the number of cores 20 scrapped at startup when a new spool of raw material is inserted. As can be seen from FIG. 7, when more material is used for each core 20, fewer cores 20 (and hence less raw material) are scrapped.

The amount of additional material used per core 20 having a ⅜ inch overlap 42 is about 69.5 square inches or 69,500 square inches per 1,000 cores 20. However, each scrapped core 20 comprises about 1,140 square inches. On the average, 72 fewer cores 20, or 81,800 fewer square inches per 1.000 cores 20, are scrapped utilizing a core 20 according to FIG. 3. This yields a savings of 81,800 square inches per 1,000 cores 20. Therefore, the cores 20 according to the present invention save about 12,200 square inches of material per 1,000 cores 20. Each case of product has about 4.36 cores 20 therein. This invention saves about 53.4 square inches of core 20 material per case of product.

Furthermore, as illustrated by FIG. 7, the cores 20 according to the present invention exhibit improved converting efficiency. In FIG. 7, data points 1 and 7 are taken from actual plant data. Datum point 1 represents the cores 20 according to the prior art, which establish the baseline efficiency. Datum point 7 represents a core 20 having an overlap 42 of 0.375 inches and an improved efficiency of about 0.9 percent. A savings of 0.9 percent downtime translates to thousands of dollars in savings over the course of a year. Data points 2–6 and 8–9 are calculated from laboratory measurements. In the laboratory measurements a cone is inserted into the end 30 of a core 20 and compressed until failure occurs.

In the plant, the prior art cores 20' exhibited a loss of about 6.9 cores 20 out of every 1,000 cores 20 attempted to be manufactured. The losses were approximately equally distributed between cores 20 that were horizontally crushed at the bottom of the bins, cores 20 that jammed in the converting area, and cores 20 that exploded on the mandril. When cores 20 according to the present invention were tested on the converting line, the scrap rate dropped from 6.9 cores 20 per 1,000, to about 1.5 cores 20 per 1,000. This improved scrap rate alone represents a significant savings for a consumer product as inexpensive as toilet tissue.

In addition to the gains in converting efficiency illustrated by FIG. 7 recognized by utilizing cores 20 according to the present invention, there are also benefits in the core-making process. Particularly, core making according to the present invention yields an improvement of approximately 7 percent. This savings occurs because fewer cores 20 are scrapped during the core-making process. Cores 20 are scrapped during the core-making process because the plies 22, 24 delaminate near the ends 30 of the cores 20. Such delamination causes the cores 20 to jam during converting. Accordingly, such cores 20 must be sorted and scrapped during the core-making operation.

Utilizing cores 20 according to the present invention, approximately 7 percent fewer cores 20 were scrapped, compared to cores 20 according to the prior art. This results in an additional savings of 79,500 square inches of material per 1,000 cores 20, or 347 square inches of material per case of product.

However, additional savings were recognized from the present invention. The cores 20 that were crushed or exploded on the converting mandril caused a loss of almost 2 percent of the paper product because it must also be scrapped along with the cores 20. Utilizing the cores 20 according to the present invention reduced the scrap rate to less than 1 percent. This alone represents a tremendous financial savings and economizes natural resources when the phenomenal volume of toilet tissue produced during a year is considered.

Furthermore, yet another benefit recognized by the present invention is increased efficiency. Every time the converting mandril has to be cleared due to the paper product being crushed or the cores 20 exploding, downtime ensues. By reducing this downtime which is not reflected by FIG. 7, the product can be produced at higher efficiencies and lower cost.

Preferably, the overlap 42 for the embodiments described above with respect to FIGS. 3, 4, and 6 extend the entire longitudinal distance between the opposed ends 30 of the core 20. However, it will be recognized that at least a portion of the benefits can be achieved if the overlaps 42 do not traverse the entire longitudinal distance between the ends 30 of the core 20.

Similarly, with respect to the embodiment of FIG. 5, the separate ply 44 preferably traverses the entire distance between the opposed ends 30 of the core 20. However, it is to be recognized that again at least a portion of the benefits can be recognized with a ply 44 applied to only the central portion of the core 20 or to outboard portions of the core 20.

It is to be recognized though that any embodiment which has longitudinal discontinuities, such as an overlap 42 or a ply 44, which is intermittently present in the core 20 will present manufacturing complexities. Additionally, converting efficiency improves and downtime decreases as fewer cores 20 are utilized during startup and raw material scrap decreases.

It will be apparent that many other variations, and permutations of the foregoing embodiments are feasible, all of which are within the scope of the appended claims.

What is claimed is:

1. A two-ply core having a generally round cross section with an inner circumference and an outer circumference, said core comprising an inner ply and an outer ply joined together in face-to-face relationship without an intervening ply therebetween, said inner ply and said outer ply each having a predetermined width defined by two edges and being spirally wound together to form a hollow cylinder, said outer ply subtending an arc greater than 360 degrees forming an outer ply overlap, said outer ply overlap being disposed on the outer circumference of said core wherein said inner ply is not disposed diametrically outwardly of any portion of said outer ply, and said inner ply subtending an arc greater than 360 degrees forming an inner ply overlap, said inner ply overlap being disposed on the inner circumference of said core wherein said outer ply is not disposed diametrically inwardly of any portion of said inner ply.

2. A core according to claim 1 wherein said core has two oppositely disposed ends and said inner ply overlap and said outer ply overlap extend from one said end of said core to the other said end of said core.

3. A method of making a two-ply core having a generally round cross section with an inner circumference and an outer circumference and a length defined by opposed ends, said method comprising the steps of:

providing two plies; and winding said plies together in face to face joined relationship to form an elongate hollow core having a wall throughout its length of not less than two plies, wherein said step of winding, said plies comprises winding said plies so that said outer ply has an outer ply overlap, said outer ply overlap being disposed on the outer circumference of said core wherein said inner ply is not disposed diametrically outwardly of any portion of said outer ply, and said inner ply has an inner ply overlap, said inner ply overlap being disposed on the inner circumference of said core wherein said outer ply is not disposed diametrically inwardly of any portion of said inner ply.

* * * * *

UNITED STATES PATENT AND TRADEMARK OFFICE

CERTIFICATE OF CORRECTION

PATENT NO. : 5,671,897

DATED : September 30, 1997

INVENTOR(S) : RANDY GENE OGG ET AL.

It is certified that error appears in the above-identified patent and that said Letters Patent is hereby corrected as shown below:

Column 3, line 41, delete "as".

Column 5, line 55, delete "1.000" and insert therefor – 1,000 --.

Signed and Sealed this

Twenty-fourth Day of February, 1998

*Attest:*

Bruce Lehman

BRUCE LEHMAN

*Attesting Officer*

*Commissioner of Patents and Trademarks*